US008564224B2

(12) United States Patent
Sprangle et al.

(10) Patent No.: US 8,564,224 B2
(45) Date of Patent: Oct. 22, 2013

(54) HIGH AVERAGE CURRENT, HIGH QUALITY PULSED ELECTRON INJECTOR

(75) Inventors: Phillip A. Sprangle, Great Falls, VA (US); Steven H. Gold, New Carrollton, MD (US); Antonio C. Ting, Silver Spring, MD (US); Joseph R. Penano, Fairfax Station, VA (US); Daniel F. Gordon, Waldorf, MD (US); Bahman Hafizi, Bethesda, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 323 days.

S.J. Russell, "Overview of high-brightness, high-average-current photoinjectors for FELs," Nucl. Inst. and Methods Phys. Res. A 507, p. 304 (2003).

(21) Appl. No.: 13/109,131

(22) Filed: May 17, 2011

(65) Prior Publication Data

US 2011/0304283 A1 Dec. 15, 2011

Related U.S. Application Data

(60) Provisional application No. 61/353,790, filed on Jun. 11, 2010.

(51) Int. Cl.
*H01J 23/06* (2006.01)
*H01J 3/14* (2006.01)

(52) U.S. Cl.
USPC ..... 315/500; 250/396 R

(58) Field of Classification Search
USPC ..... 315/500; 250/396 R
See application file for complete search history.

(56) References Cited

U.S. PATENT DOCUMENTS

| | | | | | |
|---|---|---|---|---|---|
| 5,274,299 | A * | 12/1993 | Vegter | 313/293 |
| 5,407,633 | A * | 4/1995 | Hasker et al. | 419/19 |
| 5,814,940 | A * | 9/1998 | Fujisawa | 315/5.41 |
| 5,990,622 | A * | 11/1999 | Schult et al. | 315/5.37 |
| 7,285,915 | B2 * | 10/2007 | Mako et al. | 315/5.12 |
| 2007/0228922 | A1 * | 10/2007 | Nakasuji | 313/364 |

OTHER PUBLICATIONS

Phillip Sprangle, Joseph Peñano, Bahman Hafizi, Daniel Gordon, Steven Gold, Antonio Ting, and Chad Mitchell, Phys. Rev. ST Accel. Beams, vol. 14, pp. 20702-1-20702-15.

S.J. Russell, "Overview of high-brightness, high-average-current photoinjectors for FELs," Nucl. Inst. and Methods Phys. Res. A 507, p. 304 (2003).

* cited by examiner

*Primary Examiner* — Jerome Jackson, Jr.
*Assistant Examiner* — David Lotter
(74) *Attorney, Agent, or Firm* — US Naval Research Laboratory; Joslyn Barritt

(57) ABSTRACT

An electron injector including an electron source and a conducting grid situated close to the electron source, one or more RF accelerating/bunching cavities operating at the same fundamental RF frequency; a DC voltage source configured to bias the cathode at a small positive voltage with respect to the grid; a first RF drive configured to apply an RF signal between the cathode and grid at the fundamental and third harmonic RF frequencies; and a second RF drive configured to apply an RF drive signal to the accelerating/bunching cavities. Electrons are emitted by the cathode and travel through the grid to the accelerating/bunching cavities for input into an RF linac. The first RF drive applies a first RF drive signal at the fundamental frequency of the linac plus higher harmonics thereof to the gap between the cathode and the grid to cause the emitted electrons to form electron bunches and the second RF drive applies a second RF drive signal to the accelerating/bunching cavities on the other side of the grid to further accelerate and optimize the size of the electron bunches. Because the applied RF signals contain at the fundamental linac frequency, the electrons are bunched at that frequency and each RF bucket of the linac is filled with an electron bunch.

18 Claims, 3 Drawing Sheets

Grid detail

HIGH AVERAGE CURRENT, HIGH QUALITY PULSED ELECTRON INJECTOR

CROSS-REFERENCE

This application is a nonprovisional of and claims the benefit of priority based on U.S. Provisional Patent Application No. 61/353,790 filed on Jun. 11, 2010, the entirety of which is hereby incorporated by reference into the present application.

TECHNICAL FIELD

The present invention relates to electron injectors for radio frequency (RF) linear accelerators, especially electron injectors capable of producing electrons suitable for use in high average power free electron lasers.

BACKGROUND

Radio-frequency linear accelerators (RF linacs) can generate high average current electron beams used in many important applications such as high average power free-electron laser sources, intense x-ray sources, positron sources, high frequency (harmonic) RF sources, and terahertz (THz) sources. These sources in turn have major commercial, defense, and homeland security applications such as sterilization, sensing of contraband and special nuclear materials, directed energy applications, and materials processing.

An RF linac consists of an electron source followed by a series of RF accelerating cavities that raise the energy of the injected electrons to the level required by the particular application. The electron source, often referred to in the art as an "electron injector" can consist of just a cathode (either thermionic, field emission, or photoemission) in the wall of the first accelerating cavity, or may be a more complicated structure that does its own initial electron acceleration and bunching, for example, with DC or RF fields, prior to injecting the electrons into the main linac.

The properties of the electron injector play a major role in determining the properties of the electron beam produced by the linac, including the electron beam's energy spread, transverse emittance, and temporal structure (i.e., microbunch length). The average current available from any given RF linac is primarily limited by the cw average currents available from the electron source used, but it can also be affected by other factors such as beam loading of the RF cavities, wall heating (in the case of normally conducting cavities), and the effect of electrons that return to the cathode of the injector as a result of being injected into the linac at an incorrect RF phase for capture and acceleration in the linac.

A high average current linac is one in which the total electron charge accelerated in a single period of the rf drive is high, a large fraction of the rf periods are filled with electron charge while the rf drive is on (ideally, all of the rf periods are filled), and the rf drive is continuous in time, rather than present only in short duration rf pulses. By these means, the cw average current of the linac will be high and therefore suitable for high average current applications.

One particularly important application of a high average current RF linac is as an electron source for a high average power infrared free electron laser (FEL). See, e.g., Phillip Sprangle, Joseph Peñano, Bahman Hafizi, Daniel Gordon, Steven Gold, Antonio Ting, and Chad Mitchell, *Phys. Rev. ST Accel. Beams*, vol. 14, pp. 020702-1-020702-15.

A typical FEL comprises a high average current RF linac such as an energy recovery linac (ERL), a wiggler magnet, optical components, and a beam dump for the spent electron beam. The operating parameters of the FEL impose significant requirements on the quality of the electron beam input into the RF linac from the electron injector. The electron injector must provide a high current relativistic electron beam in which the electrons are in the form of bunches that are short compared to the RF period associated with operating frequency of the RF linac. For example, for a high power FEL, every RF bucket in the ERL must be filled with charge, and so for a 700 MHz RF linac with no subharmonic section, the electron injector must generate electron bunches of order 100 psec in pulse length at a 700 MHz pulse repetition rate.

Moreover, in order to produce an average current of ~1 A, the instantaneous current should be about an order of magnitude higher, with the charge per bunch on the order of 1 nC or higher. For such short bunches and high repetition rate, it is not practical to generate short high voltage pulses to apply to the grid of an electron gun, and direct RF modulation of the cathode-grid gap is required.

Several types of electron injectors have been used with RF linacs within the existing state of the art. These include thermionic injectors using DC high voltage electron guns, RF thermionic or field emission injectors, and laser photocathode injectors. Each of these has major limitations that do not permit high current operation at ~1 A average current.

For example, thermionic and field emission cathodes without grids have no method to directly gate the electron emission. In the presence of an RF field, they will emit electrons over 180 degrees of RF phase, and thus do not support the short pulse format required for formation of electron micropulses having the necessary characteristics. The best current technology electron injectors for low average power FELs use laser photocathode electron guns and conventional first harmonic RF structures. However, this technology cannot be scaled to produce the required average beam current of ~1-2 A because the low quantum efficiency of the cathodes would require very high average laser powers to create the high average current beam. See e.g., S. J. Russell, "Overview of high-brightness, high-average-current photoinjectors for FELs," *Nucl. Inst. and Methods Phys. Res. A* 507, p. 304 (2003) In fact, these injectors have not yet demonstrated even ~100 mA of average beam current.

There are two additional problems with extending laser photocathode technology to generate high average current beams. First, the required lasers do not exist, and second, the required laser power, if it were available, would destroy the cathode due to excessive thermal loading. Thus, such electron injectors are not suitable for use with a 1 MW FEL.

Gridded thermionic electron guns also have been used as electron sources for RF linacs, and are capable of direct modulation at frequencies of order 1 GHz. These guns use barium dispenser cathodes and pyrolytic graphite grids, and are well known to the state of the art, since they are used as part of commercial RF amplifier tubes known as inductive output tubes (IOTs). In the IOT, the gun operates with a negative bias of ~30-40 kV between the cathode and the anode, which is at ground potential, as well as with a small relative bias of order −100 V on the grid with respect to the cathode. The grid bias serves to prevent electron emission from the cathode until an RF signal of sufficient amplitude is induced between the cathode and grid. In the presence of such an RF signal, emission only takes place when the RF phase is such that the RF field overcomes the negative bias on the grid, producing a train of short electron bunches synchronized with the RF signal. In an IOT gun, the beam would then be accelerated up to an energy of tens of keV by the DC negative bias between the cathode and the grounded anode, and the beam extracted through the anode would be used to generate RF power by deceleration in an output cavity. This gridded thermionic electron gun thus produces inherently low energy electrons and relatively long micropulses that are not suitable for use in an FEL.

Thus, there is a need for a new electron injector capable of generating high quality relativistic electron bunches for further acceleration in a high average current RF linac such as an ERL. This injector would replace the other means of generating the initial electron bunches required , such as laser-photocathodes injectors or DC or RF thermionic injectors.

SUMMARY

This summary is intended to introduce, in simplified form, a selection of concepts that are further described in the Detailed Description. This summary is not intended to identify key or essential features of the claimed subject matter, nor is it intended to be used as an aid in determining the scope of the claimed subject matter. Instead, it is merely presented as a brief overview of the subject matter described and claimed herein.

The present invention provides an electron injector capable of producing a high average current, high power pulsed electron beam suitable for further acceleration and use in high current, high power applications such as free electron lasers (FELs). The present invention also provides a method of producing such a high average current, high power pulsed electron beam by the application of RF signals containing both the fundamental and higher harmonics of the linac frequency.

An electron injector in accordance with the present invention includes an electron source such as a thermionic barium dispenser cathode and a conducting grid such as a pyrolytic graphite grid situated close to the cathode, wherein the cathode-grid gap is capable of being modulated at a fundamental RF frequency and one or more harmonics thereof; one or more RF accelerating/bunching cavities operating at the same fundamental RF frequency as used to modulate the cathode-grid gap; a DC voltage source configured to bias the cathode at a small positive voltage with respect to the grid; a first RF drive configured to apply an RF signal between the cathode and grid at the fundamental and third harmonic RF frequencies; and a second RF drive configured to apply an RF drive signal to the accelerating/bunching cavities.

In accordance with the present invention, electrons are emitted by the cathode and travel through the grid to the accelerating/bunching cavities for input into an RF linac. The first RF drive applies a first RF drive signal at the fundamental frequency of the linac plus higher harmonics thereof to the gap between the cathode and the grid. The applied RF signal causes the emitted electrons to form electron bunches that travel through the grid into the accelerating/bunching cavities on the other side of the grid. The second RF drive applies a second RF drive signal to the accelerating/bunching cavities to further accelerate and optimize the size of the electron bunches as they travel through the injector. Because the applied RF signals contain at the fundamental linac frequency, the electrons are bunched at that frequency and each RF bucket of the linac is filled with an electron bunch. The cathode and grid are situated at the end of the first accelerating/bunching cavity, so that the RF fields of the first cavity begin to accelerate the electron bunches as soon as they pass through the grid. In addition, the grid is electrically connected to the first cavity. As a result, the first and second RF signals remain separate, with their amplitude and phase being independently controllable, and thus the controlled production of high quality electron bunches having a desired frequency and size from the injector can be achieved.

DETAILED DESCRIPTION

Figure 1:
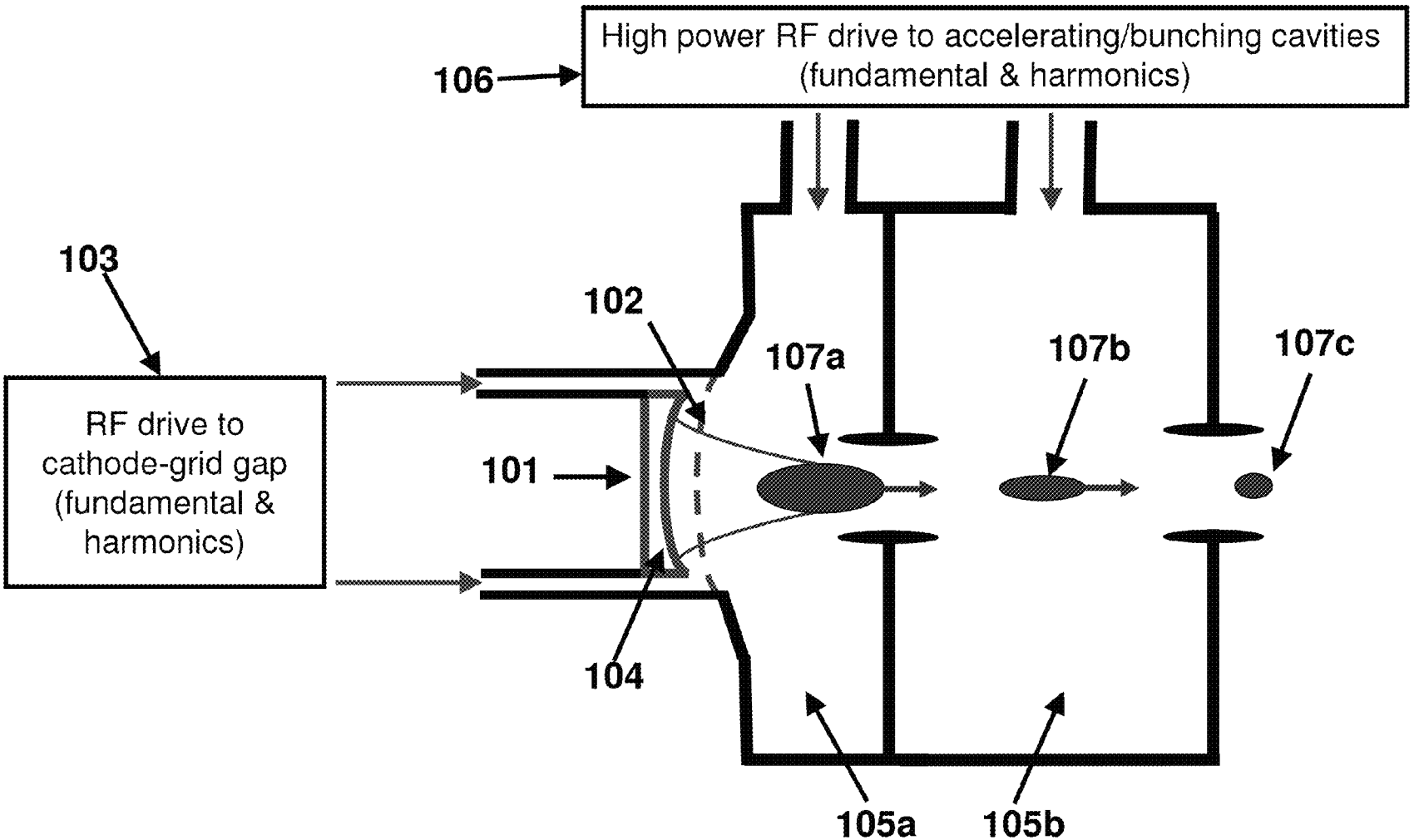
FIG. 1 is a block diagram depicting an exemplary configuration of an electron injector in accordance with the present invention.

The aspects and features of the present invention summarized above can be embodied in various forms. The following description shows, by way of illustration, combinations and configurations in which the aspects and features can be put into practice. It is understood that the described aspects, features, and/or embodiments are merely examples, and that one skilled in the art may utilize other aspects, features, and/or embodiments or make structural and functional modifications without departing from the scope of the present disclosure.

The present invention provides an electron injector capable of producing a high average current, high power pulsed electron beam suitable for further acceleration and use in high current, high power applications such as free electron lasers (FELs). The present invention also provides a method of producing such a high average current, high power pulsed electron beam by the application of RF signals containing both the fundamental and higher harmonics of the linac frequency.

An electron injector in accordance with the present invention includes an electron source such as a thermionic barium dispenser cathode and a conducting grid such as a pyrolytic graphite grid situated close to the cathode, wherein the cathode-grid gap is capable of being modulated at a fundamental RF frequency and one or more harmonics thereof; one or more RF accelerating/bunching cavities operating at the same fundamental RF frequency as used to modulate the cathode-grid gap; a DC voltage source configured to bias the cathode at a small positive voltage with respect to the grid; a first RF drive configured to apply an RF signal between the cathode and grid at the fundamental and third harmonic RF frequencies; and a second RF drive configured to apply an RF drive signal to the accelerating/bunching cavities.

In accordance with the present invention, electrons are emitted by the cathode and travel through the grid to the accelerating/bunching cavities for input into an RF linac. The first RF drive applies a first RF drive signal at the fundamental frequency of the linac plus higher harmonics thereof to the gap between the cathode and the grid. The applied RF signal causes the emitted electrons to form electron bunches that travel through the grid into the accelerating/bunching cavities on the other side of the grid. The second RF drive applies a second RF drive signal to the accelerating/bunching cavities to further accelerate and optimize the size of the electron bunches as they travel through the injector. Because the applied RF signals contain at the fundamental linac frequency, the electrons are bunched at that frequency and each RF bucket of the linac is filled with an electron bunch. The cathode and grid are situated at the end of the first accelerating/bunching cavity, so that the RF fields of the first cavity begin to accelerate the electron bunches as soon as they pass through the grid. In addition, the grid is electrically connected to the first cavity. As a result, the first and second RF signals remain separate, with their amplitude and phase being independently controllable, and thus the controlled production of high quality electron bunches having a desired frequency and size from the injector can be achieved.

Figure 2:
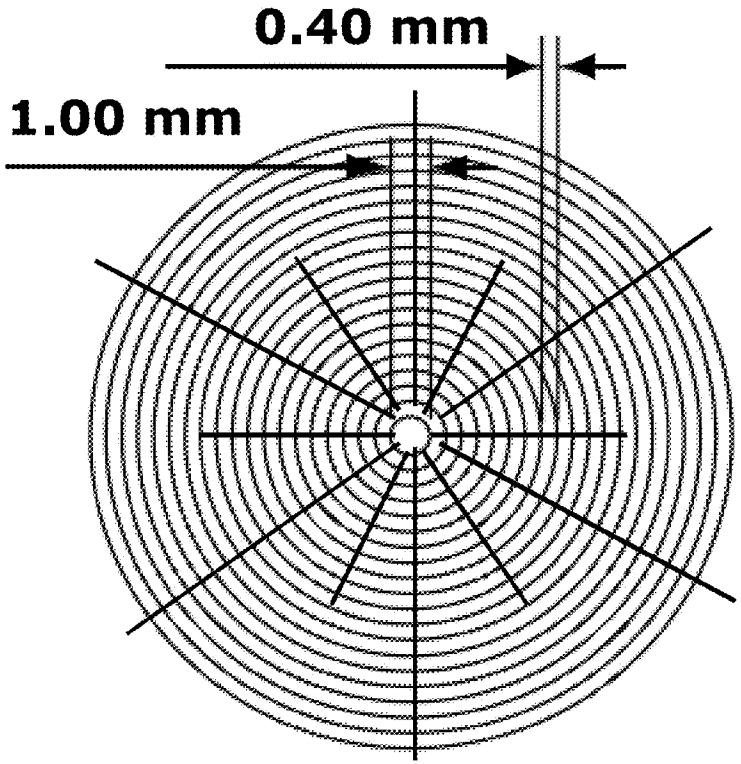
FIG. 2 depicts an exemplary configuration of a grid used with an electron injector in accordance with the present invention.

FIGS. 1 and 2 illustrate aspects of an exemplary embodiment of an electron injector in accordance with the present invention.

As shown in FIG. 1, and as described in more detail below, an electron injector in accordance with the present invention can include an electron source such as a thermionic barium dispenser cathode 101, a conducting grid 102, and one or more acceleration/bunching cavities 105*a*/105*b*, all situated within a housing 100.

The electron injector of the present invention does not include an anode. In the place of an anode, the electron injector of the present invention has one or more accelerating/bunching cavities 105*a*/105*b* situated just beyond grid 102 opposite cathode 101. As shown in FIG. 1, cathode 101 and grid 102 are mounted in a coaxial configuration, aligned with the apertures in RF accelerating/bunching cavities 105*a*/105*b* that allow electron bunches 107*a*/107*b*/107*c* to pass through the injector. Cathode 101 and RF drive 103 are on one side of grid 102 and accelerating/bunching cavities 105*a*/105*b* are on the other side of grid 102.

The electron injector in accordance with the present invention further includes a DC voltage source (not shown), an RF drive 103 configured to provide an RF signal to the gap between cathode 101 and grid 102 and a high power RF drive 106 configured to provide a high power RF signal to acceleration/bunching cavities 105*a*/105*b*. The DC voltage source can be any suitable voltage source such as conventional DC power supply and RF drives 103 and 106 can be any suitable RF drive such as a solid state oscillator and a klystron amplifier.

There is no negative high voltage bias on cathode 101. The only DC voltage that is present is a small bias voltage of order +100 V applied by the DC voltage source between cathode 101 and grid 102. Grid 102 and accelerating/bunching cavities 105 are at ground potential so that grid 102 has a negative bias with respect to cathode 101.

In an exemplary configuration such as that shown in FIG. 2, grid 102 consists of an array of concentric wires and radial spokes fabricated from pyrolytic graphite, though other conductive materials and/or grid configurations may also be suitable and may be used within the scope of the present invention. Cathode 101 and grid 102 are situated at an end of the first accelerating/bunching cavity 105*a* closest to RF drive 103. Grid 102 is situated very close to cathode 101, with the gap 104 between grid 102 and cathode 101 being on the order of 250 μm. As described in more detail below, the gap 104 between the cathode 101 and grid 102 is modulated by the RF fields produced by RF drive 103, while accelerating/bunching cavities 105*a*/105*b* are modulated by RF fields produced by RF drive 106. As described in more detail below, the presence of the grid permits the amplitude and phase of each of these RF signals to be independently controlled, which enables the controlled production of high quality electron bunches having a desired frequency and size as output from the electron injector.

In accordance with the present invention, electrons are emitted from cathode 101 and pass through cathode-gap 104 and grid 102 into the accelerating/bunching cavities 105*a*/105*b*. In accordance with the present invention, RF drive 103 applies a first RF signal to grid-cathode gap 104. As a result of the RF signal applied to cathode-grid gap 104, the emitted electrons pass through grid 102 and enter the first accelerating/bunching cavity 105*a* in the form of an electron beam consisting of short electron bunches spaced in time, such as electron bunch 107*a* shown in FIG. 1.

Figure 3:
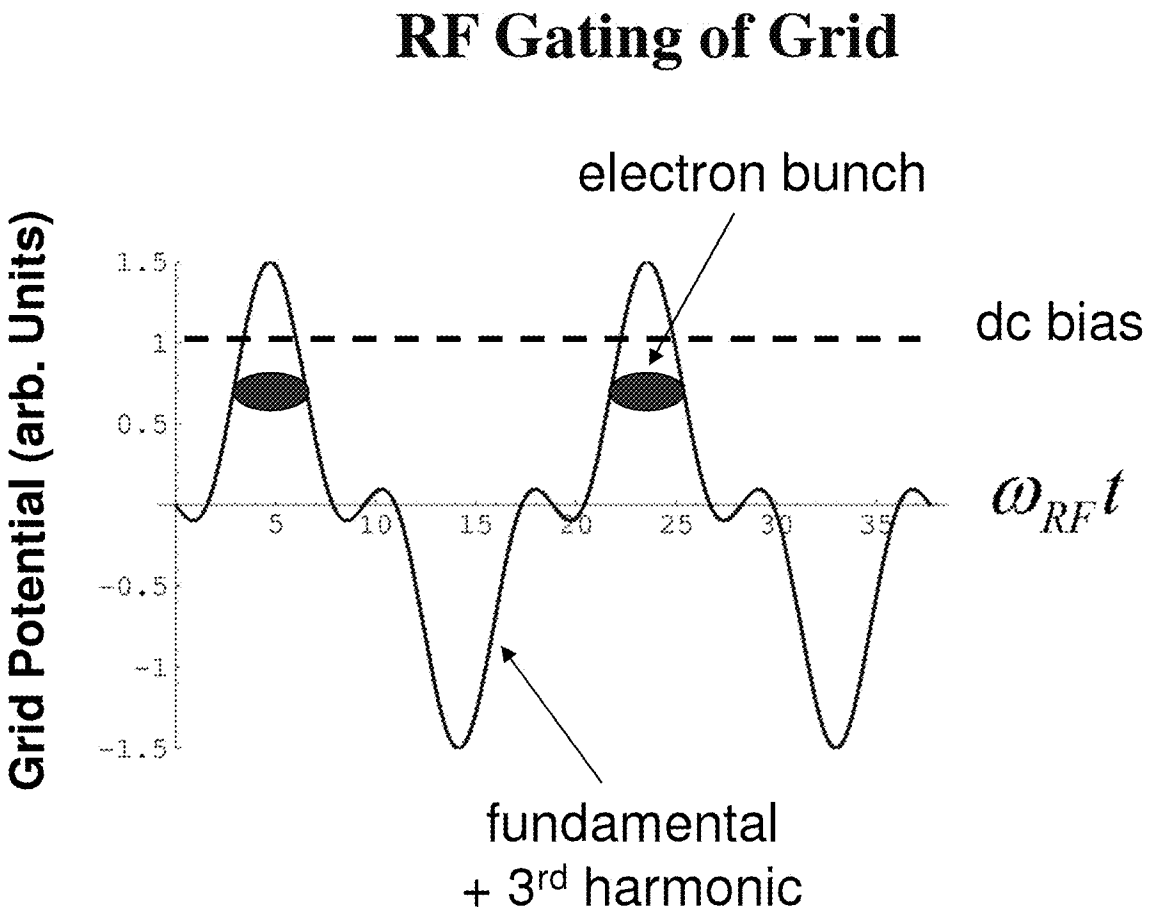
FIG. 3 illustrates the short electron bunches that can be achieved using the fundamental and $3^{rd}$ harmonic of the RF frequency combined with a DC grid bias in accordance with the present invention.

In order to produce electron bunches that are short enough to enter the main RF linac, which contains additional rf acceleration, the first RF signal provided by RF drive 103 to cathode-grid gap 104 is modulated at the fundamental RF frequency of the linac (e.g., ~700 MHz) and simultaneously at higher harmonics of the fundamental RF frequency. Because gap 104 is modulated at the fundamental linac frequency, every accelerating RF bucket is filled with an electron bunch as illustrated in FIG. 3, while the addition of the third harmonic causes the bunches to be shorter. In the preferred configuration of this invention, the fundamental and third harmonics are used, though in other embodiments, other odd and/or even harmonics could be applied to the grid to further optimize the length of the electron bunches. Through the use of a thermionic cathode 101 and pyrolytic graphite grid 102 modulated at the fundamental and harmonic linac frequencies in accordance with the present invention, short electron bunches can be produced at a rate up to 1 GHz.

As soon as an electron bunch 107*a* passes through grid 102, it is further accelerated by the second RF signal applied by high power RF drive 106 to accelerating/bunching cavities 105*a*/105*b*. The second RF signal would contain the same fundamental frequency as the first RF signal applied to grid 102, but can also contain harmonics of the fundamental frequency. In addition, because grid 102 is situated at an end of the first accelerating/bunching cavity 105*a*, the RF fields of the first accelerating cavity 105*a* reach the surface of grid 102 that faces away from cathode 101. However, because grid 102 is in electrical contact with the walls of accelerating/bunching cavity 105*a*, there is no leakage of the first RF signal into the cavity 105*a* and no leakage of the second RF signal into grid-cathode gap 104, and consequently, it is possible to vary the RF amplitude and phase independently in the two regions. In this way, it is possible to even further shorten the electron bunches 107*a* that had passed through the first cavity to produce shorter electron bunches 107*b* and 107*c* as the final output of the injector.

In addition, the RF fields in the accelerating/bunching cavities 105*a*/105*b* could also contain even higher harmonics of the fundamental frequency in order to further reduce the width of the electron bunches; this could be accomplished by making the cavities square or rectangular in cross section, rather than round, so that can support integer harmonics of a fundamental frequency. As another alternative, the electron injector can include more than just the two accelerating/bunching cavities shown in FIG. 1, with the harmonic frequencies used in separate cavities following the first accelerating cavity to further reduce the size of the bunch.

The high quality, high average current electron beam produced by these means is designed to be suitable for additional rf acceleration in a conventional linac or ERL, and then used for applications such as FELs.

FIG. 3 illustrates the modulation of the grid potential that can be achieved using the combination of DC bias and fundamental and $3^{rd}$ harmonic RF drive. The figure schematically indicates the generation of short electron bunches of ~100 psec (rms) duration can be obtained at a repetition rate of 700 MHz. These bunches are formed when the combined modulation of gap 104 by the fundamental and third harmonic RF frequencies combine to overcome the effective of the negative DC bias voltage applied between grid 102 and cathode 101.

Advantages and New Features

Thus, an electron injector according to the present invention contains at least the following new features: (a) modulation of the cathode-grid gap at the fundamental and harmonic frequencies to generate short electron bunches at up to 1 GHz; and (b) situation of the grid in the end wall of the first RF cavity to eliminate the anode beyond the grid as well as any DC electric field beyond the cathode-grid gap. As a result of this second feature of the present invention, the instantaneous accelerating electric field gradient experienced by the electron bunches can be substantially increased, compared to the maximum DC electric field that could be sustained without breakdown by means of a DC bias between a cathode and anode. This makes it possible to rapidly accelerate the electron bunches before the bunches spread due to the effects of the space charge of the bunches, producing higher quality electron bunches. In addition, in accordance with the present invention, the strength of the RF electric field on the downstream side of the grid compared to the peak RF field in the first cavity can be adjusted by changing the shape of the end wall of the cavity and positioning the grid in a depression in the end wall of the cavity.

Alternatives

There are many variations possible to adapt this invention to different specific applications, or to employ different materials or geometries in the injector For example, in addition to applying the fundamental and third harmonic RF frequencies to the grid, additional integer harmonic frequencies can be applied to further decrease the length of the electron microbunches. Also, the first RF cavity may contain additional odd integer harmonic RF frequencies in addition to the fundamental frequency. This could be done by employing a cavity with either square or rectangular cross section, rather than a cavity with circular cross section.

Also, while a barium dispenser cathode and pyrolytic graphite grid are described in an exemplary embodiment, alternative materials include Scandium for the cathode and tungsten for the grid.

In addition, while a concave cathode is depicted in FIG. 1, in order to produce a convergent electron beam, a flat cathode could also be employed, for example, to facilitate RF cavity design.

Moreover, while an injector that includes two RF cavities is shown in FIG. 1, the injector could include one or a multiplicity of cavities.

Although particular embodiments, aspects, and features have been described and illustrated, it should be noted that the invention described herein is not limited to only those embodiments, aspects, and features, and it should be readily appreciated that modifications may be made by persons skilled in the art. The present application contemplates any and all modifications within the spirit and scope of the underlying invention described and claimed herein, and all such embodiments are within the scope and spirit of the present disclosure.

What is claimed is:

1. An electron injector comprising:

an electron source configured to emit electrons into the injector;

a conducting grid situated close to the electron source;

an RF accelerating/bunching cavity on an opposite side of the grid from the electron source the conducting grid being electrically connected to the RF accelerating/bunching cavity;

a DC voltage source configured to bias the electron source at a small positive voltage with respect to the grid;

a first RF drive configured to apply a first RF drive signal to a gap between the electron source and the grid, the applied first RF drive signal containing both the fundamental and at least one first selected harmonic RF frequency of an RF linac configured to receive electrons from the electron injector; and a second RF drive configured to apply a second RF drive signal to the accelerating/bunching cavity, the second RF drive signal containing both the fundamental and at least one second selected harmonic RF frequency of the RF linac, the second RF drive being electrically separate from the first RF drive so that at least one of an amplitude, a phase, and a harmonic of the second RF drive signal is controllable independently from an amplitude, phase, and a harmonic of the first RF drive signal;

wherein the first RF drive signal is configured to cause the electrons emitted from the electron source to form electron bunches that travel through the grid into the accelerating/bunching cavity, the fundamental frequency causing the electron bunches to be configured to fill each accelerating RF bucket and the at least one first selected harmonic being configured to cause the electron bunches to have a desired first size;

wherein the second RF drive signal is configured to accelerate and optimize the electron bunches for input into the RF linac, the at least one second selected harmonic being configured to cause the electron bunches to have a desired second side; and wherein the electron bunches are configured to fill each RF bucket of the linac as a result of the first and second applied RF drive signals.

2. The electron injector according to claim 1, wherein the electron source comprises a thermionic barium dispenser cathode.

3. The electron injector according to claim 1, wherein the electron source comprises a Scandium cathode.

4. The electron injector according to claim 1, wherein the electron source comprises a concave cathode.

5. The electron injector according to claim 1, wherein the electron source comprises a flat cathode.

6. The electron injector according to claim 1, wherein the grid comprises an array of concentric wires and radial spokes.

7. The electron injector according to claim 1, wherein the grid comprises a pyrolytic graphite grid.

8. The electron injector according to claim 1, wherein the grid comprises a tungsten grid.

9. The electron injector according to claim 1, wherein at least one of the first and the second RF drive signals comprises the fundamental and third harmonics of the RF linac.

10. The electron injector according to claim 1, wherein the accelerating/bunching cavity has a circular cross-section.

11. The electron injector according to claim 1, wherein the accelerating/bunching cavity has a rectangular cross-section.

12. The electron injector according to claim 1, further comprising a plurality of accelerating/bunching cavities, the RF drive signal applied to each of the accelerating/bunching cavities containing the fundamental and at least one higher harmonic of the RF linac frequency.

13. The electron injector according to claim 12, wherein the RF drive signal applied to at least one of the plurality of accelerating/bunching cavities is different from the RF drive signal applied to at least one other of the plurality of accelerating/bunching cavities.

14. The electron injector according to claim 12, wherein at least one of the plurality of accelerating/bunching cavities has a cross-sectional shape different than at least one other of the plurality of accelerating/bunching cavities, the RF drive signal applied to at least one of the plurality of accelerating/bunching cavities containing additional harmonic frequencies as a result of the cross-sectional shape of the cavity.

15. A method of producing a pulsed electron stream for injection into an RF linac, comprising:

applying a first RF drive signal from a first RF drive source to a gap between an electron source and an conducting grid in an electron injector, the first RF drive signal containing a fundamental RF frequency of the linac and at least one first selected harmonic thereof, the first RF drive signal being configured to cause electrons emitted from the electron source to form electron bunches which travel through the conducting grid into an accelerating/bunching cavity, the fundamental frequency causing the electron bunches to be configured to fill each accelerating RF bucket and the at least one first selected harmonic being configured to cause the electron bunches to have a desired first size; and applying a second RF drive signal from a second RF drive source to the accelerating/bunching cavity, the second RF drive signal containing the fundamental RF frequency of the linac and at least one second selected harmonic thereof, at least one of an amplitude, a phase, and a harmonic of the second RF drive signal being controllable independently from an amplitude, a phase, and a harmonic of the first RF drive signal, the at least one second selected harmonic being configured to cause the electron bunches to have a desired second size;

wherein the electron bunches comprise a pulsed electron stream configured to fill each RF bucket of the RF linac as a result of the first and second applied RF drive signals.

16. The method according to claim 15, wherein the second RF drive signal contains the same harmonic frequency as the first RF drive signal.

17. The method according to claim 15, wherein the second RF drive signal contains at least one harmonic frequency different from a harmonic frequency contained in the first RF drive signal.

18. The method according to claim 15, further comprising applying a plurality of second RF drive signals to a corresponding plurality of accelerating/bunching cavities, each of the plurality of second RF drive signals containing the fundamental RF frequency and at least one harmonic thereof.

* * * * *